US005497607A

United States Patent [19]

Branson

[11] Patent Number: 5,497,607

[45] Date of Patent: Mar. 12, 1996

[54] TWO-FOR-ONE TWISTING SPINDLE WITH BRISTLE RING FOR SMOOTHING AND TENSIONING THREADS

[75] Inventor: Thomas Branson, Thomasville, N.C.

[73] Assignee: Palitex Project-Company GmbH, Krefeld, Germany

[21] Appl. No.: 249,755

[22] Filed: May 25, 1994

[30] Foreign Application Priority Data

May 26, 1993 [DE] Germany ..... 9307967 U

[51] Int. Cl.[6] ..... D01H 1/10; D01H 7/86

[52] U.S. Cl. ..... 57/58.52; 57/58.83; 57/58.86; 57/352; 57/354; 57/356

[58] Field of Search ..... 242/147 R, 47.01, 242/128; 57/58.49, 58.52, 58.7, 58.83, 58.84, 58.86, 352, 353, 354, 355, 356

[56] References Cited

U.S. PATENT DOCUMENTS

| | | | |
|---|---|---|---|
| 2,838,922 | 6/1958 | Gift | 242/128 |
| 3,632,062 | 1/1972 | Sole | 242/147 R |
| 4,222,535 | 9/1980 | Hosbein | 242/128 |
| 4,434,609 | 3/1984 | Schacht | 57/58.86 |
| 4,469,290 | 9/1984 | Frentzel-Beyme | 242/128 |
| 4,687,149 | 8/1987 | Riva | 242/47.01 |
| 4,744,394 | 5/1988 | Lincke | 242/47.12 |
| 4,959,951 | 10/1990 | Mori | 57/58.82 |
| 5,181,544 | 1/1993 | Deiuri | 242/47.01 |
| 5,211,347 | 5/1993 | Riva | 242/47.01 |
| 5,310,127 | 5/1994 | Deiuri | 242/47.01 |

FOREIGN PATENT DOCUMENTS

| | | | |
|---|---|---|---|
| 51050 | 5/1982 | European Pat. Off. | 242/47.01 |
| 2504944 | 11/1982 | France . | |
| 1159827 | 12/1963 | Germany | 57/58.52 |
| 9111875 | 3/1993 | Germany . | |
| 12321 | of 1885 | United Kingdom | 242/147 |
| 2102033 | 1/1983 | United Kingdom | 242/147 R |

*Primary Examiner*—William Stryjewski
*Attorney, Agent, or Firm*—Robert W. Becker & Associates

[57] ABSTRACT

A two-for-one twisting spindle has a protective pot with an upper edge and a bobbin carrier positioned in the protective pot for receiving two bobbins to be placed atop one another. A thread inlet tube extends axially through the bobbin carrier for receiving a first and a second thread withdrawn overhead from the bobbins. A thread guide ring is rotatable about the axis of the spindle. The thread guide ring has an eye for guiding one of the first and second threads withdrawn from the bobbins to the thread inlet tube, wherein the other of the first and second threads is guided about the periphery of the thread guide ring. A bristle ring is connected to the upper edge of the protective pot, the bristle ring having radially inwardly oriented, elastic bristles along which bristles the threads pass before entering the thread inlet tube.

4 Claims, 2 Drawing Sheets

TWO-FOR-ONE TWISTING SPINDLE WITH BRISTLE RING FOR SMOOTHING AND TENSIONING THREADS

BACKGROUND OF THE INVENTION

The present invention relates to a two-for-one twisting spindle with a protective pot and a bobbin carrier on which two bobbins are concentrically arranged axially atop one another from which bobbins threads are withdrawn overhead and introduced together into a thread inlet tube whereby, before the introduction of the threads into the thread inlet tube, one of the threads is guided through an eye of a thread guiding ring that rotates about the spindle axis while the other thread is guided along the periphery of the thread guiding ring.

Such a thread guiding device provides assistance in keeping the threads separate to thereby prevent interaction of the individual threads removed from the bobbins and especially prevents entanglement or loop formation of the two individual threads when one of the threads passes the other thread.

From thread storage devices it is known (compare German Gebruachsmuster 91 11 875) to use bristle rings which serve to remove the thread from a supply bobbin with a uniform tension. For this purpose, the thread is pulled between a radially inwardly oriented mantle surface of the end section of the supply bobbin and the bristles of a bristle ring positioned thereon.

It is therefore an object of the present invention to provide a two-for-one twisting spindle of the aforementioned kind with which an additional tensioning and smoothing of the individual threads can be achieved in order to provide additional safety against the formation of and especially against the introduction of thread loops into the thread inlet tube, respectively, into the spindle.

SUMMARY OF THE INVENTION

A two-for-one twisting spindle according to the present invention is primarily characterized by:

A protective pot having an upper edge;

A bobbin carrier positioned in the protective pot for receiving two bobbins so as to be placed atop one another;

A thread inlet tube extending axially through the bobbin carrier for receiving a first and a second thread withdrawn overhead from the bobbins;

A thread guide ring rotatable about an axis of the spindle, the thread guide ring having an eye for guiding one of the first and second threads withdrawn from the bobbins to the thread inlet tube, wherein the other of the first and second threads is guided about the periphery of the thread guide ring; and A bristle ring connected to the upper edge of the protective pot, the bristle ring having radially inwardly oriented, elastic bristles along which bristles the threads pass before entering the thread inlet tube.

Advantageously, the bristles of the bristle ring are positioned at an upward slant. Expediently, the upward slant of the bristles is adjustable.

The two-for-one twisting spindle according to the present invention preferably further comprises an annular projection positioned on the bristle ring such that the annular projection rests on the bristles, wherein by adjusting a spacing between the annular projection and the bristle ring the upward slant of the bristles is adjustable.

Preferably, the two-for-one twisting spindle further comprises an annular flange to which the annular projection is connected, the annular flange having downwardly extending spring tongues with a radially inwardly oriented catch. A screw collar ring for securing the bristle ring to the upper edge of the protective pot is provided. The screw collar ring has a plurality of exterior grooves at various levels for receiving the catch of the downwardly extending spring tongues.

Expediently, the bristles of the bristle ring are slanted in a direction of withdrawal of the threads.

In another embodiment of the present invention the bristle ring is preferably vertically adjustable.

According to the present invention, the two-for-one twisting spindle is characterized by a bristle ring that is positioned on the upper edge of the protective pot and has radially inwardly oriented, elastic bristles along which the threads are guided on their way to the thread inlet tube.

In this manner, the individually guided threads withdrawn from the bobbins and guided by the rotating thread guide ring are subjected to an additional tensioning and smoothing upon passing along the bristle ring so that the introduction of possibly produced thread loops into the spindle is reliably prevented.

The individual bristles, which are preferably connected to an annular member, are radially inwardly oriented and upwardly slanted whereby it is advantageous to provide an additional slant of the bristles from their radial orientation in the direction of withdrawal of the individual threads.

In order to adjust the intensity of the effect of the bristles on the individual threads to respective specifications, the bristle ring is preferably vertically adjustable relative to the protective pot whereby especially the component of upwardly slant of the bristles can be modified, preferably by an annular projection resting on top of the bristles. The vertical position of the annular projection relative to the bristle ring can be adjusted.

The annular projection preferably is part of a flange extending radially outwardly past the annular member to which the bristles are connected whereby the flange is provided with at least one catch for interlocking in grooves provided at different levels.

BRIEF DESCRIPTION OF THE DRAWINGS

The objects and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 4.

Figure 1:
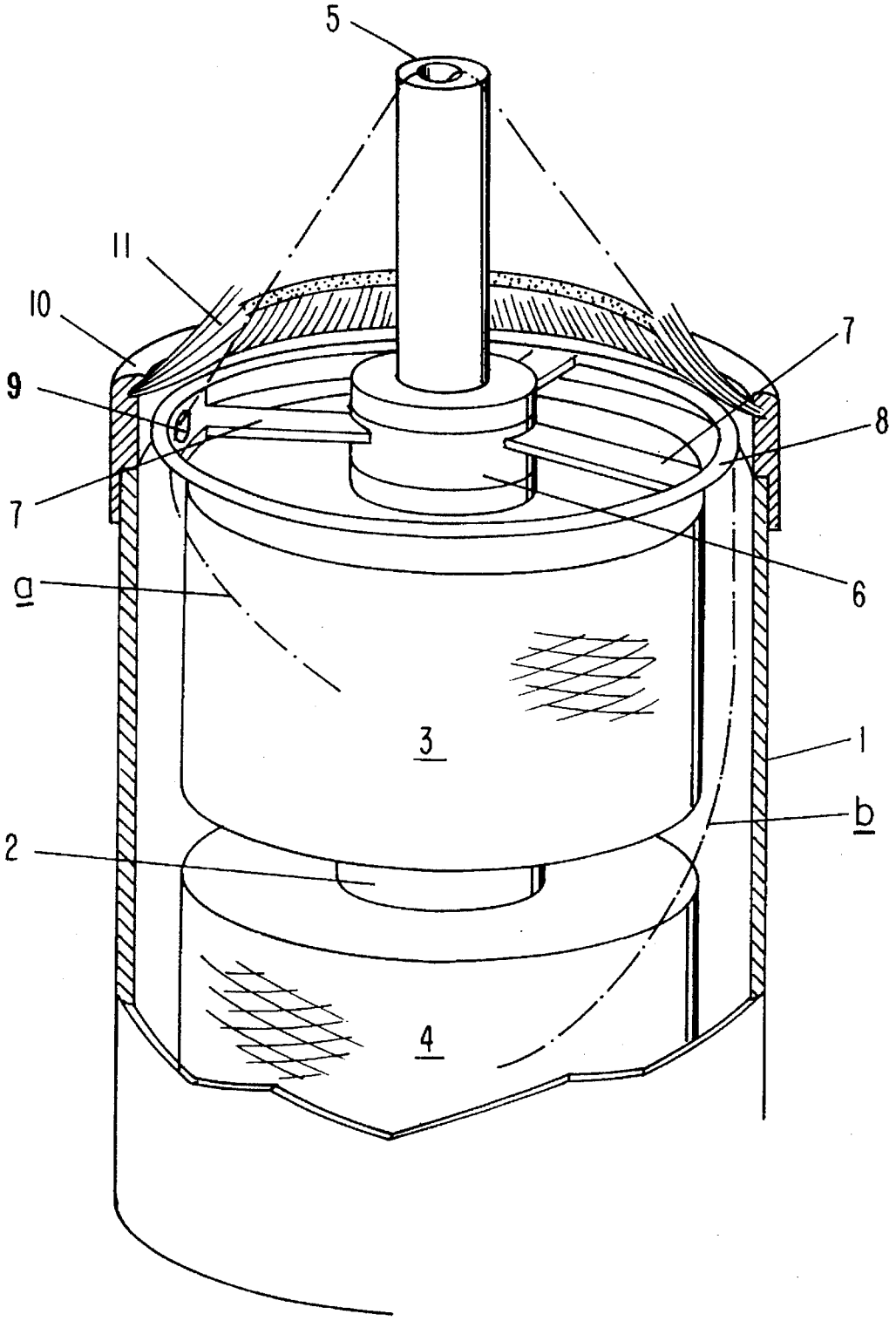
FIG. 1 shows a portion, partially in section, of a side view of a two-for-one twisting spindle with two supply bobbins positioned atop one another on the spindle.

FIG. 1 shows the protective pot 1 of a two-for-one twisting spindle in which two supply bobbins 3 and 4 are placed on a bobbin carrier 2. Onto the conventional thread inlet tube 5 a hub 6 is slipped, preferably as a part of the bobbin carrier 2. A thread guide ring 8 is connected with spokes 7 to the hub 6 and can thus freely rotate about the axis of the spindle. The thread guide ring 8 in the area of one of the spokes 7 is provided with an eye 9 which at a location with the greatest possible radial distance from the axis of the spindle is provided with a non-represented threading slot. The eye 9 in the circumferential direction of the thread guide ring 8 is essentially in the form of a slotted hole.

At the upper edge of the protective pot 1 an annular member 10 as a securing element for the bristle ring 11 is provided which is preferably detachable from the upper edge and which has connected thereto elastic radially inwardly oriented bristles that preferably are upwardly slanted.

During operation of the two-for-one twisting spindle the individual thread a, which is removed from the upper supply bobbin 3, is guided through the eye 9 of the thread guide ring 8 which rotates with the thread, while the other thread b removed from the lower supply bobbin 4 is guided about the circumference of the thread guide ring 8. The individual threads a and b which are introduced into the thread inlet tube 5 are thus first guided by the rotating thread guide ring 8 and subsequently, by passing along the bristles of the bristle ring 11 above the thread guide ring 8, are tensioned and smoothed so that the introduction of thread loops into the spindle is prevented.

Figure 2:
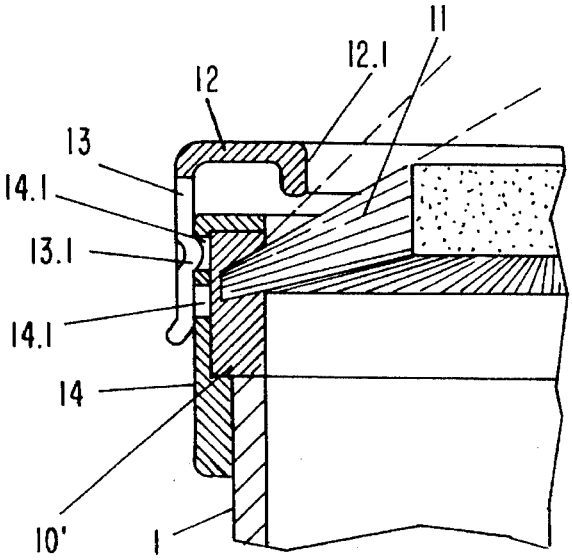
FIGS. 2 and 3 show a portion of an adjusting device for adjusting the bristles of the bristle ring at different levels.
Figure 3:
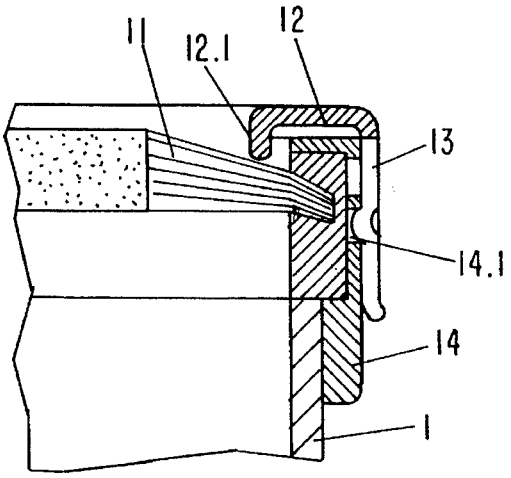

According to FIGS. 2 and 3 the inner ends of the bristle ring 11, relative to the upper edge of the protective pot 1 and thus relative to the thread guide ring 8, may be positioned at different levels. For this purpose, an annular projection 12.1 as a part of an annular flange 12 is provided which annular projection 12.1 is downwardly oriented. The annular flange 12 is provided with downwardly extending spring tongues 13 that have radially inwardly oriented catches 13.1. These catches 13.1 may engage grooves 14.1 provided at various heights of a screw collar ring 14. The screw collar ring 14 is provided to secure the bristle ring 11, respectively, the annular member 10' on the protective pot 1.

Figure 4:
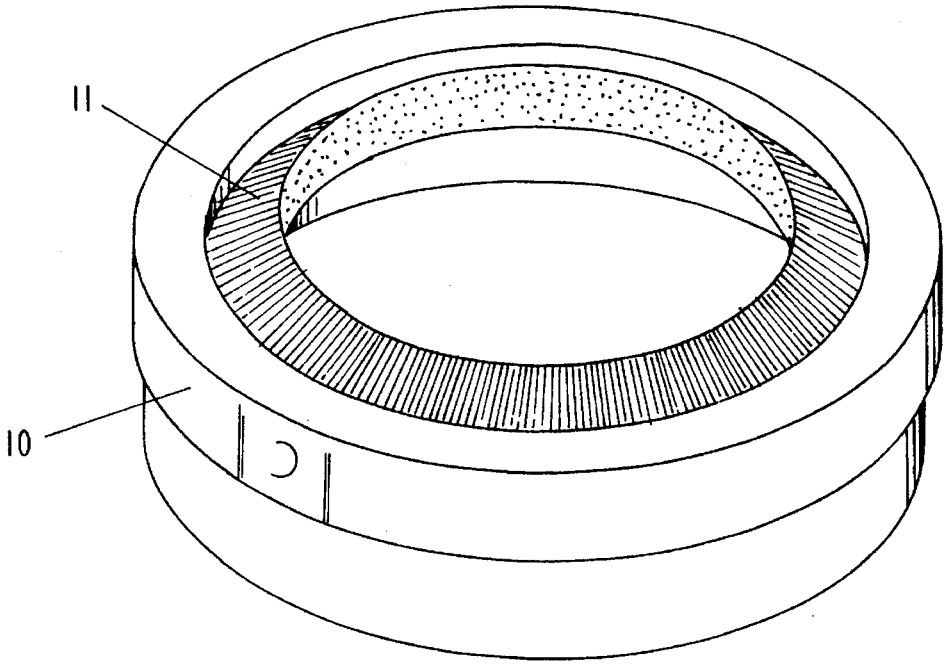
FIG. 4 shows a perspective representation of a bristle ring including the securing and fastening elements.

According to FIG. 2, the annular projection 12.1 is in an upper position in which it does not contact the bristle ring 11 so that the bristles of the bristle ring 11 are in their erect position. According to FIG. 3 the annular projection 12.1 is displaced downwardly to such an extent that its lower edge rests at the upper side of the bristle ring 11 so that the bristle ring 11 is forced downwardly. FIG. 4 shows the bristle ring 11 with its annular member 10 detached from the two-for-one twisting spindle. The bristles of the bristle ring are preferably slanted relative to the radial direction in the direction of withdrawal of the two individual threads.

The present invention is, of course, in no way restricted to the specific disclosure of the specification and drawings, but also encompasses any modifications within the scope of the appended claims.

What I claim is:

1. A two-for-one twisting spindle comprising:

a protective pot having an upper edge;

a bobbin carrier positioned in said protective pot for receiving two bobbins to be placed atop one another;

a thread inlet tube extending axially through said bobbin carrier for receiving a first and a second thread withdrawn overhead from the bobbins;

a thread guide ring rotatable about an axis of said spindle, said thread guide ring having an eye for guiding one of the first and second threads withdrawn from the bobbins to said thread inlet tube, wherein the other of the first and second threads is guided about the periphery of said thread guide ring;

a bristle ring connected to said upper edge of said protective pot, said bristle ring having radially inwardly oriented, elastic bristles positioned at an upward slant, along which bristles the threads pass before entering said thread inlet tube, wherein said upward slant of said bristles is adjustable; and an annular projection positioned on said bristle ring such that said annular projection rests on said bristles, wherein by adjusting a spacing between said annular projection and said bristle ring said upward slant is adjustable.

2. A two-for-one twisting spindle according to claim 1, further comprising:

an annular flange to which said annular projection is connected, said annular flange having downwardly extending spring tongues with a radially inwardly oriented catch; and a screw collar ring for securing said bristle ring to said upper edge of said protective pot, said screw collar ring having a plurality of exterior grooves at various levels for receiving said catch of said downwardly extending spring tongues.

3. A two-for-one twisting spindle according to claim 1, wherein said bristles are slanted in a direction of withdrawal of the threads from the bobbins.

4. A two-for-one twisting spindle according to claim 1, wherein said bristle ring is vertically adjustable.

* * * * *